United States Patent [19]

Crain

[11] 4,095,341

[45] Jun. 20, 1978

[54] CARPET TRIMMER

[75] Inventor: Millard Crain, Pleasanton, Calif.

[73] Assignee: Crain Cutter Company, Inc., Santa Clara, Calif.

[21] Appl. No.: 844,644

[22] Filed: Oct. 25, 1977

[51] Int. Cl.[2] ..... B26B 29/00

[52] U.S. Cl. ..... 30/287; 30/293; 30/294

[58] Field of Search ..... 30/294, 293, 289, 286, 30/287, 288

[56] References Cited

U.S. PATENT DOCUMENTS

| | | | |
|---|---|---|---|
| 2,772,474 | 12/1956 | Hill et al. | 30/293 |
| 3,363,314 | 1/1968 | O'Brien | 30/293 X |
| 3,395,453 | 8/1968 | Prater | 30/293 |
| 3,535,786 | 10/1970 | Sanders | 30/293 |
| 3,581,397 | 6/1971 | Kochanowski | 30/293 |
| 3,605,267 | 9/1971 | Brenner | 30/293 |

*Primary Examiner*—Gary L. Smith
*Assistant Examiner*—J. T. Zatarga
*Attorney, Agent, or Firm*—Jack M. Wiseman

[57] ABSTRACT

A carpet trimmer comprising a base plate with slots directed at right angles to the working edge of the base plate. Underlying the base plate is a post holder with upstanding threaded posts protruding through the slots of the base plate. Overlying the base plate is a blade holder that engages the posts for movement with the post holder. Suitable nuts on the posts lock the post holder and the blade holder in an adjusted position relative to the base plate. A wall guide depends from the blade holder in spaced relation to the working edge of the base plate to define a passageway for a carpet edge to be trimmed by blades on the blade holder. When the nuts are loosened, the posts can be moved within the slots of the base plate toward or away from the working edge of the base plate. In so doing, the post holder and the blade holder move therewith. This action adjusts the distance between the working edge of the base plate and the wall guide to accommodate different thicknesses of carpets.

9 Claims, 7 Drawing Figures

Fig-3
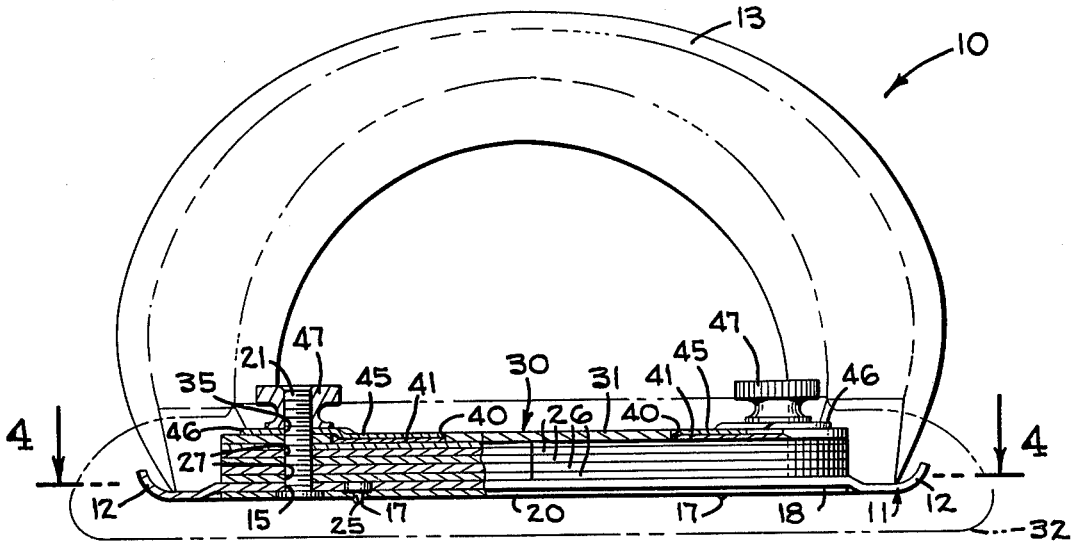
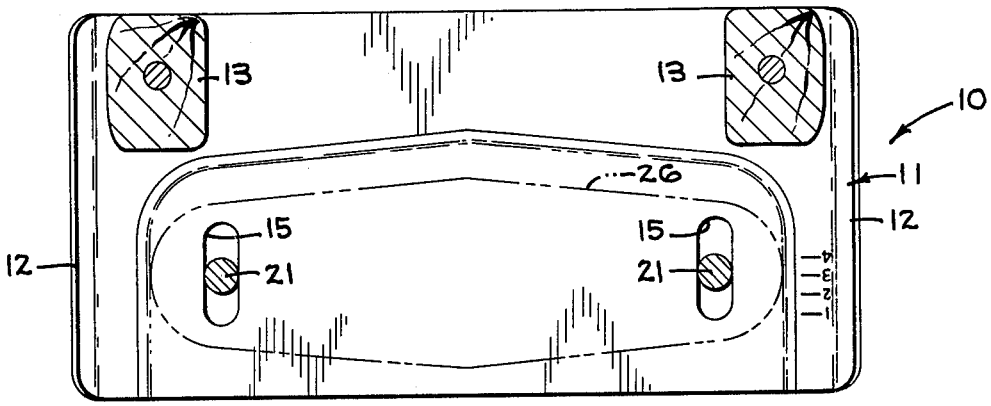
Fig-4
Fig-5
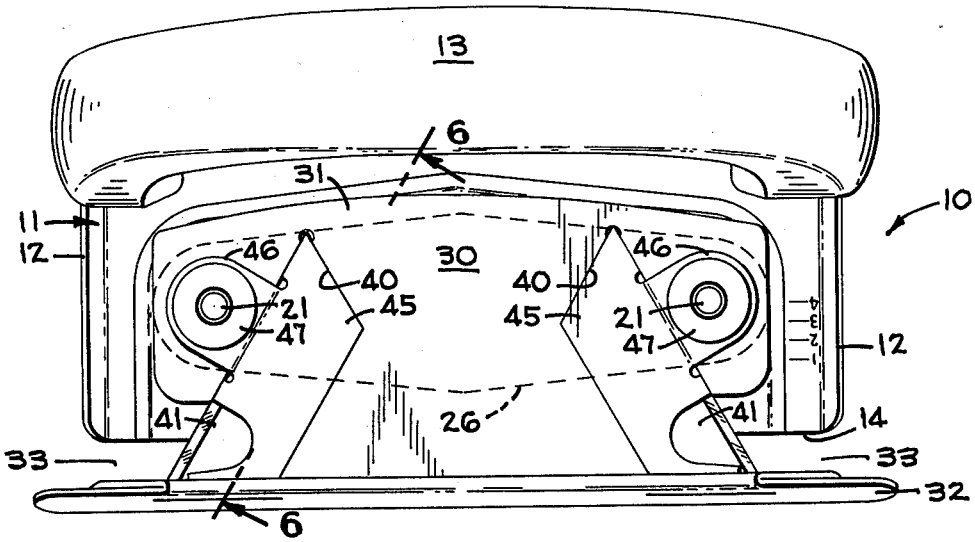

CARPET TRIMMER

BACKGROUND OF THE INVENTION

The present invention relates in general to tools for the installation of carpets, and more particularly, to a carpet trimmer.

Heretofore, Roberts Consolidated Industries of Industry City, California, produced a carpet trimmer identifiable as Model 10 616, which appears to be described in the patent to Hill et al. U.S. Pat. No. 2,772,474, for Carpet Trimmer. The carpet trimmer comprises a base plate with upstanding, threaded posts. A blade holder overlies the base plate and is formed with elongated openings. Between the base plate and the blade holder is a complementary plate also formed with elongated openings. The openings of the base holder and the openings of the complementary plate complement one another so that slots are formed directed at right angles to the working edge of the base plate to receive the posts on the base plate. Nuts on the posts lock the blade holder and the complementary plate in an adjusted position relative to the base plate. The blade holder includes a depending wall guide spaced from the working edge of the base plate to define a working edge for a carpet edge to be trimmed by blades on the blade holder. When the nuts are loosened, the blade holder and the complementary plate can be moved relative to the base plate within the limits of the walls of the aforementioned slots for adjusting the distance between the working edge of the base plate and the wall guide of the blade holder to accommodate the various thicknesses of carpets.

The patent to Brenner U.S. Pat. No. 3,605,267, for Carpet Trimming Tool discloses a carpet trimmer in which the carpet entry space between the working edge of a base plate and the wall guide of a blade holder is adjusted by transversely spaced, aligned notches on the lateral edges of the blade holder and cooperating projections or detents on the base plate. In the patent to O'Brien U.S. Pat. No. 3,363,314, for Carpet Trimming Tool, there is disclosed a carpet trimmer for height adjustment in which slotted openings are in a vertical wall of a base plate. Projections are provided on a clamping member for the blades, which register with the slotted openings in the base. The location of the projections in the slotted openings are selected to adjust the height of the blades relative to the base plate.

Other U.S. Pats. of interest are the following:

Sanders, No. 3,535,786

Kochanowski, No. 3,581,397

Prater, No. 3,395,453

Heretofore, the adjustment of the carpet entry space between the working edge of the base plate and the wall guide of the blade holder was rather inconvenient and cumbersome. The extend of the adjustment movement required was not readily observable and was rather obscured.

SUMMARY OF THE INVENTION

A carpet trimmer comprising a base plate. Underlying the base plate is a post holder with upstanding posts. The base plate is formed with slots directed at right angles to the working edge of the base plate and the upstanding posts protrude through the slots formed in the base plate. Overlying the base plate is a blade holder which engages the posts for movement with the post holder relative to the base plate. The blade holder includes a guide spaced from the working edge of the base to define therebetween a carpet entry for the edge of the carpet to be trimmed. The carpet entry space can be adjusted to accommodate carpets of various thicknesses by moving the posts within the slots formed in the base plate through the simultaneous movement of the post holder and the blade holder relative to the base plate. Suitable locking means retain the post holder and the blade holder in the adjusted position relative to the base plate.

By virtue of the present invention, the adjustment of the carpet entry space between the working edge of the base plate and the guide of the blade holder is facilitated. The convenience and ease of operation with which this procedure is carried out are noteworthy. Additionally, the extent of the adjustment required is now readily observable by the user of the carpet trimmer.

DESCRIPTION OF THE DRAWINGS

FIG. 3 is a front elevation view of the carpet trimmer shown in FIG. 1 with a wall guide on a blade holding plate broken away to illustrate the stacked spacer plates for blade height adjustment.

FIG. 4 is a horizontal section view taken along line 4—4 of FIG. 3.

FIG. 5 is a plane view of the carpet trimmer shown in FIG. 1.

DESCRIPTION OF THE PREFERRED EMBODIMENT

Figure 1:
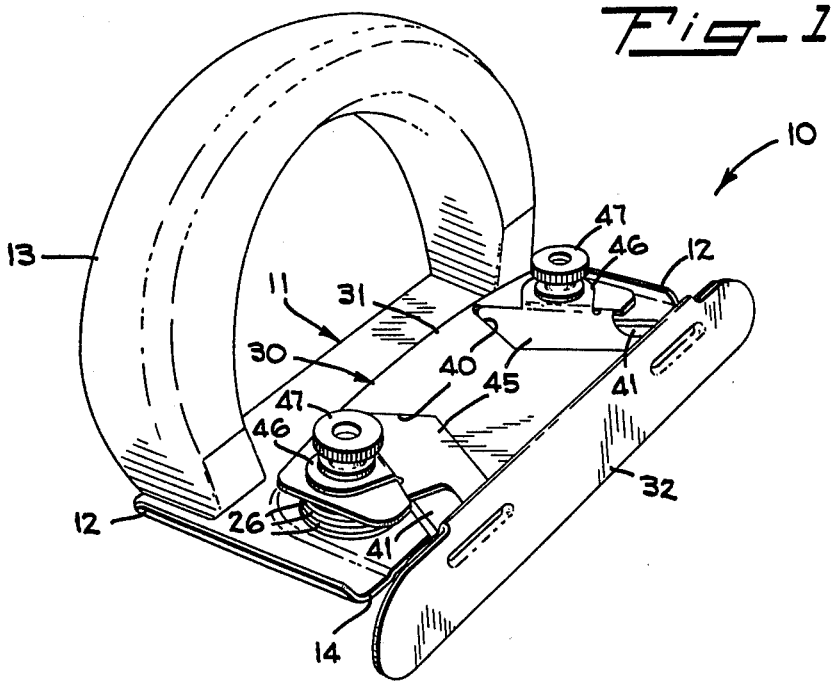
FIG. 1 is a perspective view of a carpet trimmer embodying the present invention.

Illustrated in FIG. 1 is a carpet trimmer 10 embodying the present invention which comprises a relatively flat base plate 11. The base plate 11, in the preferred embodiment, has a rectangular configuration. At each end thereof, the base plate 11 has an upturned lip 12. Along one side of the base plate is secured a suitable handle 13. Along the opposite side of the base plate 11 is a working edge 14 for the carpet trimmer 10.

By gripping the handle 13, the carpet trimmer 10 is caused to travel in the direction of the working edge 14 and in a direction perpendicular to the upturned lips 12. In practice, the carpet trimmer 10 travels at the option of the user with either upturned lip 12 as the leading end. The carpet trimmer 10 moves along the pile or nap of the carpet with the edge of the carpet to be trimmed engaging the working edge 14 of the base plate 11. The upturned lips 12 serve to reduce the snagging of the carpet at the ends of the base plate 11.

Formed in the base plate 11 are slots 15 (FIGS. 2 and 4), which are directed at right angles to the working edge 14 of the base plate 11. The carpet riding face 16 of the base plate 11 is formed with indexing projections or detents 17 (FIGS. 2 and 3), which project away from the carpet riding face 16. Additionally, the base plate 11 is formed with a recess 18 in the carpet riding face 16 to receive in flush engagement a flat post holding plate 20 (FIGS. 2 and 3).

The flat post holding plate 20 is an adjustable member underlying the base plate 11 that is movable relative to the base plate 11 for adjusting the carpet edge entry space for the carpet trimmer 10 in accommodating the various thicknesses of carpet to be trimmed. The thickness of the adjustable plate 20 is preferably substantially equal to the recess 18 to provide a relatively flat surface for the carpet trimmer 10 in riding over the carpet to be trimmed. Fixed to the adjustable flat plate 20 are upstanding, threaded posts or studs 21 (FIGS. 2–5), which protrude through the slotted openings 15 of the base plate 11. By moving the adjustable plate 20, the location of the threaded posts 21 within the slots 15 can be selected.

Figure 2:
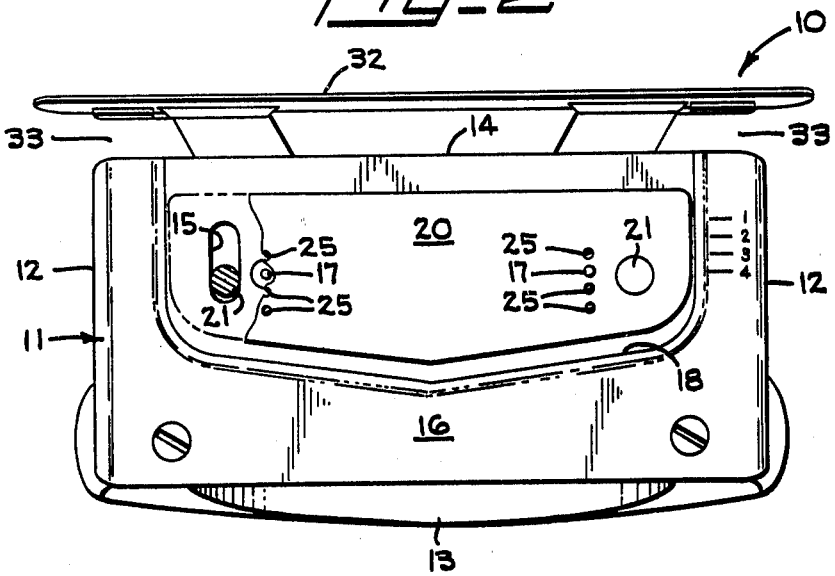
FIG. 2 is a bottom view of the carpet trimmer shown in FIG. 1 with a portion of the post holder plate broken away to illustrate a detent arrangement between the post holder plate and a base plate.

Also formed in the adjustable member 20 are two sets of openings 25 (FIGS. 2 and 3). Each set of openings 25 are spaced apart in the direction which the slots 15 are directed. When the adjustable plate 20 is moved to select a location for the threaded posts 21, the projections 17 on the base plate 11 will register with corresponding openings 25 formed in the adjustable plate 20 to gauge desired adjustment distances to correspond with known thicknesses of carpets and to retain the adjustable plate 20 in its adjusted or selected position relative to the base plate 11.

Figure 7:
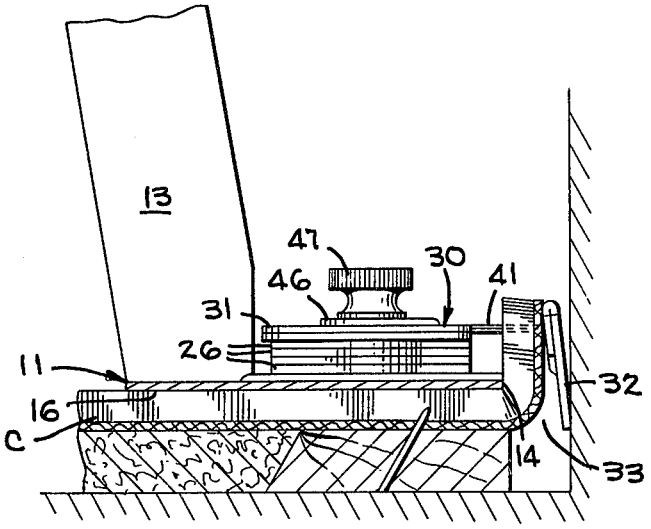
FIG. 7 is an end elevation view of the carpet trimmer shown in FIG. 1 illustrated with an edge of the carpet in the carpet entry space of the carpet trimmer.
Figure 6:
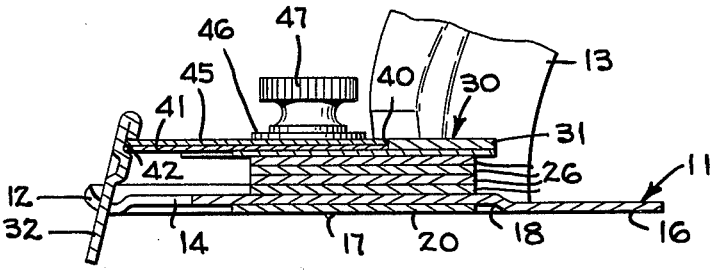
FIG. 6 is a vertical section view taken along line 6—6 of FIG. 5.

Removably mounted on the base plate 11 is a stack of flat height adjusting spacer plates 26 (FIGS. 3, 6 and 7). In the preferred embodiment, the height adjusting spacer plates 26 are formed with suitable openings 27 (FIG. 3) therethrough to receive the threaded posts 21. The height of blades for the carpet trimmer 10 is adjusted by adding or removing the spacer plates 26 from the stack mounted on the base plate 11. The employment of a stack of spacer members for adjusting the height of a blade for a carpet trimmer is well-known in the art.

Seated on the stack of spacer plates 26 in overlying relation to the base plate 11 is a blade holder 30. The blade holder 30 comprises a relativly flat horizontal base 31, which seats on the spacer plates 26, and comprises a depending wall guide 32. The outer wall of the guide 32 engages the wall of a building along the edge of the carpet to be trimmed. The inner wall of the wall guide 32, which is substantially parallel to the working edge 14 of the base plate 11, defines a carpet entry space 33 with the working edge 14 of the base plate 11 (FIGS. 5 and 7). The carpet entry space 33 is adjusted by the movement of the wall guide 32 toward or away from the working edge 14 to accommodate various thicknesses of carpets to be trimmed.

Formed in the base 31 of the blade holder 30 are suitable openings 35 (FIG. 3), which receive the threaded posts 21. By moving the adjusting plate 20 relative to the base plate 11 to move the threaded posts 21 in selected positions within the slots 15, the blade holder 30 moves therewith relative to the base plate 11 through the urgency or action of the threaded posts 21 for adjusting the carpet entry space 33. In so doing, the distance between the wall guide 32 of the balde holder 30 and the working edge 14 of the base plate 11 is adjusted by moving the blade holder 30 relative to the base plate 11.

Also formed in the base 31 of the blade holder 30 in the upper wall thereof are suitable, well-known recesses 40 within which seats blades 41 in a well-known manner. The cutting edges of the blades 41 are facing the adjacent ends of the base plate 11 to be oppositely directed and also to face the leading end of the base plate 11 dependent on the direction of movement of the carpet trimmer 10 and on which blade performs as the cutting blade. The blades are horizontally disposed and extend across the carpet entry space in engagement with the wall guide 32. Suitable recesses 42 (FIG. 6) are in the inner wall of the wall guide 32 to receive the free ends of the blades 41.

Disposed within the recesses 40 are blade retaining members 45. An ear 46 on each blade retaining member 45 receives the threaded posts 21 in a well-known manner. The retaining members 45 overlie portions of the blades 41 to removably hold the same in place on the blade holder 30. The free end of the blade retaining members 45 extend into the recesses 42 of the wall guide 32 of the blade holder 30. The thicknesses of the blade retainers 45 are such that, when seated in the recesses 40, the upper surface thereof is substantially at even height or planar with the upper wall of the base 31 of the blade holder 30. Suitable knurled nuts 47 are in threaded engagement with the threaded posts 21 to detachably hold the retainer members 45 in fixed position on the blade holder 30 to lock the blades 41 in place. In addition, this arrangement also serves to releasably secure the adjustment plate 20, the spacer members 26 and the blade holder 30 in the adjusted position relative to the base plate 11.

In the operation of the carpet trimmer 10, the height of the blades 41 is adjusted by either adding or removing spacer plates 26 from the stack thereof between the base plate 11 and the base 31 of the blade holder 30. In this manner, the desired cutting height is established and the extent of trimmed edge of the carpet to be tucked into the space in back of the tack strip is provided. Additionally, the nuts 47 are loosened to enable the adjusting plate 20 to be moved relative to the base plate 11. In so doing, the threaded posts 21 are moved in selected positions within the slots 15 formed in the base plate 11. The projections 17 on the base plate 11 and the selected openings 25 formed in the adjusting plate 20 serve as a gauge to select predetermined adjustment distances for widths of carpets and to retain the adjusting plate 20 in the adjusted position, relative to the base plate 11. The movement of the threaded posts 21 in the selected positions within the recesses 15 of the base plate 11 moves the blade holder 30 relative to the base plate 11 to vary the carpet entry space 33 between the working edge 14 of the base plate 11 and the wall guide 32 to accommodate various thicknesses for carpets to be trimmed. After the adjustment is made, the nuts 47 are tightened to retain the blade holder 30 and the adjustment member 20 in the adjusted position relative to the base member 11.

In the use of the carpet trimmer 10, the carpet riding face 16 of the base plate 11 rides on the pile or nap of a carpet C (FIG. 7) with the edge of the carpet to be trimmed disposed in the carpet entry space 33 engaging the work edge 14 of the base plate 11 and the wall guide 32 of the blade holder 30. The handle 13 moves the carpet trimmer 10 in the direction of the working edge 14 causing either one of the blades 41 to trim the edge of the carpet disposed in its path of travel. The cutting blade 41 that performs the cutting operation depends on the direction of travel of the carpet trimmer 10.

I claim:

1. A carpet trimmer comprising:

(a) a base plate, said base plate being relatively flat and comprising a wall means for travelling over a carpet to be trimmed said wall means being formed with a working edge and at least one slot directed at right angles to said working edge;

(b) a handle mounted on said base plate for moving said base plate along a path extending in the direction of said working edge;

(c) a relatively flat member underlying said base plate and movable relative to said base plate;

(d) at least one upstanding post fixed to said member and projecting through said slot formed in said base plate;

(e) a blade holder comprising a base and a wall guide depending from said base, said base of said blade holder overlying said base plate and being formed with an opening to receive said upstanding post, said depending wall guide of said blade holder being spaced from said working edge of said base plate to define a carpet entry space for receiving an edge of a carpet to be trimmed, the movement of said member relative to said base plate moves said upstanding post therewith within said slot for said upstanding post to urge said blade holder to move therewith relative to said base plate for adjusting the space between said working edge of said base plate and said wall guide of said blade holder to accommodate the width of a carpet disposed in said carpet entry space to be trimmmed;

(f) at least one blade mounted on said base of said blade holder and projecting into said carpet entry space for trimming a carpet; and (g) means on said posts to releasably lock said blade holder and said member in an adjusted position relative to said base plate.

2. A carpet trimmer as claimed in claim 1 and comprising at least one cooperating projection and a plurality of openings spaced in a direction parallel to the direction of said slot formed in said base plate, said cooperating projection and spaced openings being formed with said base plate and said member for gauging the desired adjustable movement between said wall guide of said blade holder and said working edge of said base plate and for retaining said member in the selected position relative to said base plate.

3. A carpet trimmer as claimed in claim 2 and comprising a plurality of individually removable spacer members stacked between said base plate and said base of said blade holder for controlling the distance between said base plate and said base of said blade holder for adjusting the height of said blade relative to said base plate.

4. A carpet trimmer as claimed in claim 3 wherein said spacer members are formed with vertically aligned openings for receiving said upstanding post, the movement of said upstanding post relative to said base plate moves said spacer members therewith relative to said base plate.

5. A carpet trimmer as claimed in claim 4 wherein said wall means of said base plate being formed with a recess for seating said member therein.

6. A carpet trimmer as claimed in claim 5 wherein said upstanding post is threaded and said means is threaded for threaded engagement with said post.

7. A carpet trimmer as claimed in claim 6 wherein said base of said blade holder has an upper wall, said upper wall being recessed to receive said blade.

8. A carpet trimmer as claimed in claim 7 and comprising a blade retaining member being disposed above said blade and in said recess of said upper wall of said base of said blade holder, said retaining member being formed with an ear receiving said upstanding post, said means being above said ear to releasably secure said retaining member to said base of said blade holder.

9. A carpet trimmer as claimed in claim 8 wherein said wall guide of said blade holder is formed with a recess and the free end of said blade and said retaining member extend into said recess formed in said wall guide of said blade holder.

* * * * *